US005104703A

United States Patent [19]

Rachman et al.

[11] Patent Number: 5,104,703

[45] Date of Patent: Apr. 14, 1992

[54] NON-WOVEN FABRIC SUITABLE FOR USE AS A COTTON BALE COVERING AND PROCESS FOR PRODUCING SAID FABRIC

[75] Inventors: Louis Rachman, Lubbock, Tex.; Jerome M. Rachman, New York, N.Y.

[73] Assignees: Lorraine Rachman; Paul B. Rachman; Barron S. Rachman, all of New York, N.Y.

[21] Appl. No.: 221,538

[22] Filed: Jul. 19, 1988

[51] Int. Cl.[5] ..... B27M 3/00

[52] U.S. Cl. ..... 428/35.6; 28/110; 112/438; 156/148; 206/83.5; 428/34.1; 428/102; 428/105; 428/113; 428/280; 428/281; 428/283; 428/288; 428/297; 428/300; 428/402

[58] Field of Search ..... 206/83.5; 428/34.1, 428/35.6, 102, 105, 113, 280, 281, 283, 288, 297, 402, 300; 28/110; 112/438, 62.2; 156/148

*Primary Examiner*—James J. Bell

*Attorney, Agent, or Firm*—Mason, Fenwick & Lawrence

[57] ABSTRACT

A single layer non-woven fabric suitable for use as a cotton bale covering that is a single layer batt formed of cross-lapped fiber, having a structure compacted by needle tacking, and being thermally bonded by thermally set low melt thermoplastic material intermixed throughout the batt, and stitch bonded throughout the batt. A process for producing this non-woven fabric that includes forming a webb of fiber, cross-lapping the web to form a batt, needle tacking and stitch bonding the batt, and providing low melt thermoplastic material that thermally bonds the fiber in the batt upon heating.

45 Claims, 2 Drawing Sheets

NON-WOVEN FABRIC SUITABLE FOR USE AS A COTTON BALE COVERING AND PROCESS FOR PRODUCING SAID FABRIC

BACKGROUND OF THE INVENTION

The present invention is directed to the field of non-woven fabrics, in general, and is directed to a single layer non-woven fabric suitable for use as a cotton bale covering having high strength and resistance to tears and abrasion, in particular. The fabric of the present invention can be produced at a rate faster than woven products and without the contamination problems encountered with products manufactured from woven products and especially those using polymeric yarns. The present invention is also directed to a process for producing such a non-woven fabric.

For many years, the cotton industry has sought a solution to the problem of wrapping cotton bales to protect the bales from contamination and damage during shipping. Some wraps commonly used are jute or burlap. These have the disadvantage of being loosely woven, admitting contaminants into the cotton bale, and are susceptible to tears, rips and holes that expose the wrapped cotton to contamination during storage and shipping.

Other wraps include woven polypropylene, the predominate bale wrapping material. These wraps, however, fibrillate in use, the polypropylene strands becoming closely entwined with the raw cotton and thereby contaminating it. Such contamination cannot be separated, and is extremely difficult to detect in raw fiber. Moreover, polypropylene wraps are not biodegradable or recyclable and have few end uses. An example of this type of woven wrap is disclosed in U.S. Pat. No. 4,557,958 (Barkis) wherein woven polypropylene or polyethylene fabric is infused with a series of stripes of thermoplastic resin to prevent fraying when the fabric is cut.

Non-woven cotton bale covers are disclosed in U.S. Pat. No. 3,647,139 (Manasian) and U.S. Pat. No. 3,647,061 (Kaupin).

The Manasian cotton bale cover is a bonded laminate of knitted filament net sandwiched between one layer of woven cotton fabric and a second layer of non-woven cotton fabric. The layers are bonded by adhesive. The Kaupin cotton bale cover is also a bonded laminate of three layers of material, wherein a layer of net is sandwiched between an inner layer of non-woven cotton and an outer layer of non-woven paper, such as embossed paper toweling. The three layers of the laminate are adhered by thermoplastic material applied to the inner or outer layer before joining. These covers, however, suffer from the disadvantages of being incapable of biodegradability and also of increased cost incurred in the manufacturing of a laminate bale cover.

OBJECTS OF THE PRESENT INVENTION

It is, therefore, the primary object of this invention to provide an improved bale cover.

A further object of this invention is the provision of a new type of single layer non-woven fabric suitable for use as a cotton bale covering, wherein a combination of stitch bonding and thermal bonding lend high strength and abrasion resistance to the fabric.

It is a further object of this invention to provide a non-woven single layer fabric that does not fibrillate in use as do woven polypropylene bale wrapping materials.

Still another object is to provide a non-woven single layer fabric that provides greater resistance to tears, rips and holes than conventional woven cotton bale wraps.

A further object is to provide a non-woven single layer fabric that is comparable in cost to polypropylene wraps, jute and burlap wraps, and significantly less costly than woven cotton bale wrap.

Another object of the invention is to provide a non-woven single layer fabric suitable for use as a cotton bale cover that can be produced faster than woven products, at a cost that is less than conventional all-cotton bagging materials.

Still another object of the invention is to provide a non-woven single layer fabric that is biodegradable and recyclable.

It is a further object of the invention to provide a fabric suitable as a cotton bale covering without the contamination problems encountered with bale wraps manufactured from woven polymeric yarns.

A further object of the invention is to provide a fabric suitable as a cotton bale covering comprising a fibrous web treated with a fiber finish that prevents excessive needle breakage, poor fiber penetration, inefficient stitching and reduced stitching rates.

Another object of the invention is to provide a fabric suitable as a cotton bale covering that is treated with a flame retarding compound.

Another object of the invention is the provision of a new and improved method of making non-woven fabric.

SUMMARY OF THE INVENTION

These and other objects of the invention are achieved by provision of a non-woven fabric comprising a batt of cross-lapped natural cellulosic fiber bonded by a thermally set low melt thermoplastic material and a method for making same. Natural cellulosic fiber is separated into individual fibers, a fibrous web is formed from the individual fibers, the fibrous web is cross-lapped to form a single layer batt, and the batt is needle tracked and stitch bonded. Low melt thermoplastic fiber can be blended with the natural cellulosic fiber at the beginning of the process, or low melt thermoplastic powder can be added to the batt during the process. Following stitch bonding, the batt is heated to cause the low melt thermoplastic fiber or powder to flow continuously with the natural cellulosic fiber in the batt.

DESCRIPTION OF THE PREFERRED EMBODIMENTS

Figure 1:
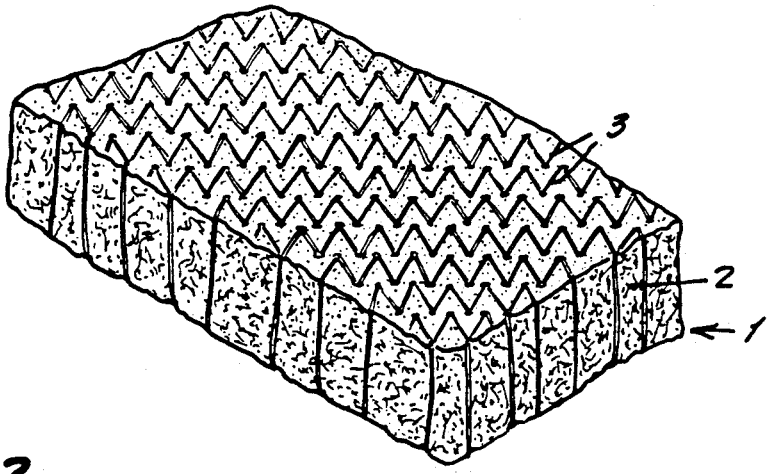
FIG. 1 is a cross-section perspective representation of one embodiment of this invention.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
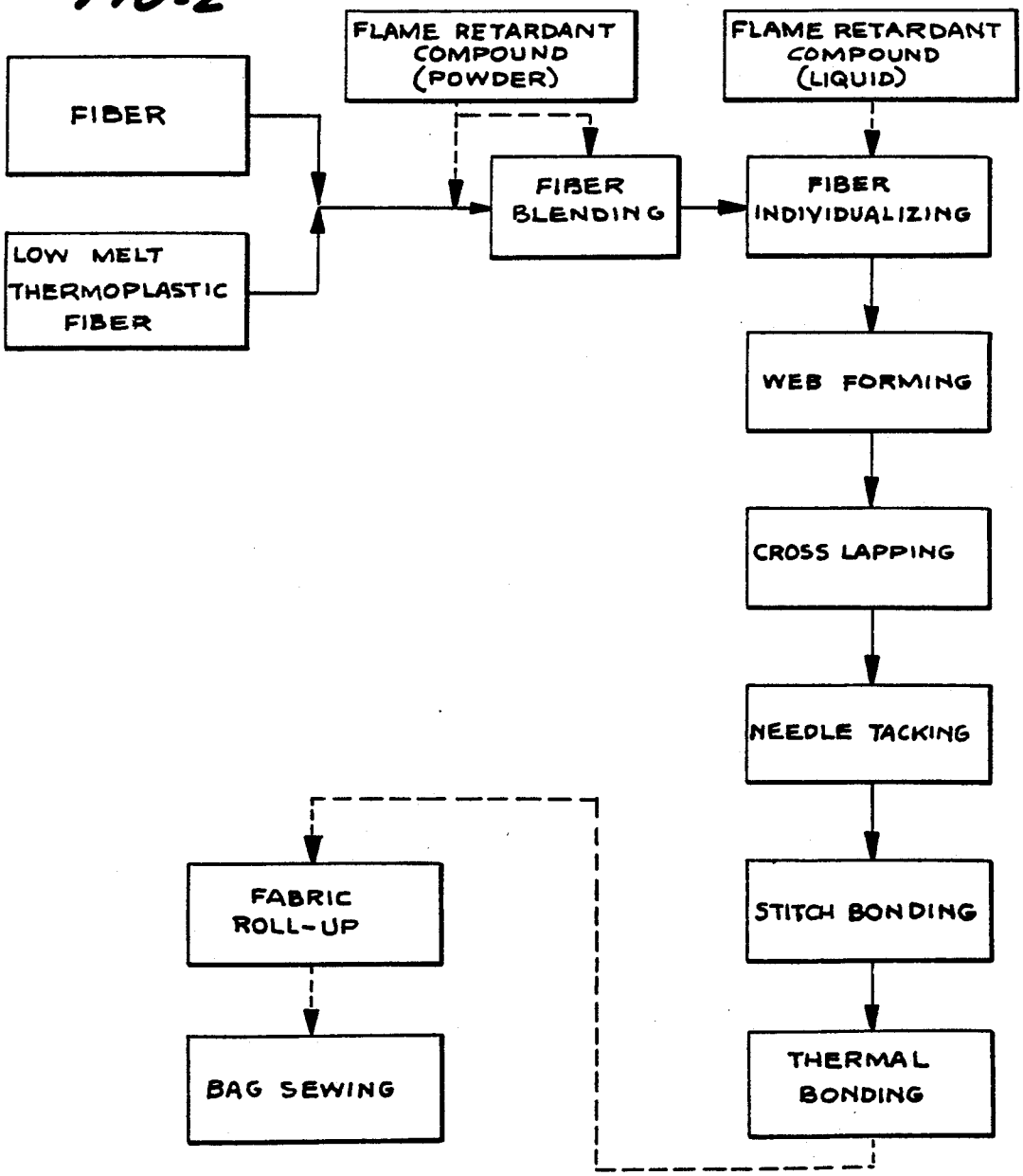
FIG. 2 is a schematic description of a method for producing a single layer non-woven fabric suitable for use as a cotton bale cover using low melt thermoplastic fiber.
Figure 3:
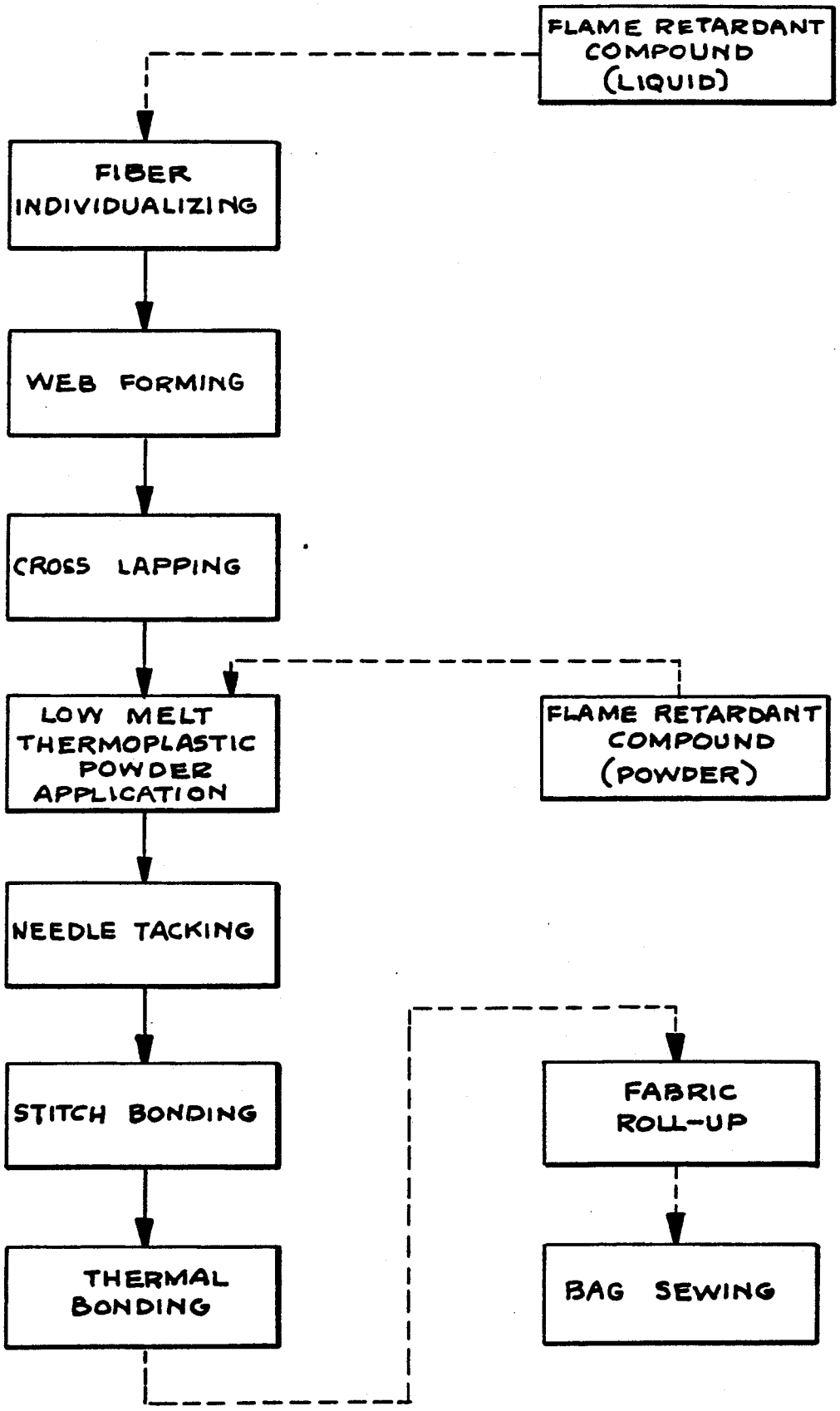
FIG. 3 is a schematic description of a method for producing a single layer non-woven fabric suitable for use as a cotton bale cover using low melt thermoplastic powder.

Illustrated in FIGS. 1, 2 and 3 are the preferred embodiments of the invention. FIG. 1 illustrates a non-woven fabric 1 formed of a single layer 2 of non-woven fibers bonded together by low melt thermoplastic fiber or powder. Stitching 3 further bonds the fabric.

The fiber used is preferably of natural cellulosic origin, such as cotton or other natural fibers, but can also be polyester, polyolefin and other suitable thermoplastic fibers. These fibers should be between 0.25 inch and 2½ inches in length and have a denier or denier equivalent between 0.8 and 20. The fibers are individualized that is, separated into individual fibers, using conventional textile fiber opening equipment and are then formed into a web using fibrous web forming devices. These may include a cotton card, garnet, wool card or air-lay machine, used in parallel or in series to produce the fibrous web. Conventional fiber opening and web forming devices are disclosed in U.S. Pat. No. 4,416,936, issued to Erickson on Nov. 22, 1983; U.S. Pat. No. 4,393,634, issued to McDermott on July 19, 1983; U.S. Pat. No. 4,113,535, issued to Lefkowitz on Sept. 12, 1978; U.S. Pat. No. 3,998,986, issued to Williams on Dec. 21, 1976; U.S. Pat. No. 3,395,065, issued to Owen on July 30, 1968; U.S. Pat. No. 3,337,387, issued to Owen on Aug. 22, 1967; U.S. Pat. No. 3,260,640, issued to Owen on July 12, 1966 and U.S. Pat. No. 3,025,199, issued to Harwood on Mar. 13, 1962.

In one embodiment of the invention, low melt thermoplastic fiber is blended with the fiber before the individualizing step. Such a blending step may be accomplished using a weight pan feeder. According to the preferred embodiment, the low melt thermoplastic fiber comprises between 5% and 40% of the total fiber content, with an optimum percentage of 18%. The low melt thermoplastic fibers may be composed of polyethylene, polyester, polypropylene, polyvinyl acetate or similar homogeneous or bicomponent fiber having a length of 0.25 inch to 2 inches and a denier of 1.0 to 10.0. The preferred length of the fiber is 1.5 inches, having a denier of 2.0.

In another embodiment, low melt thermoplastic powder is added to the fibrous web after its formation. The low melt thermoplastic powder is composed of polyethylene, polyester, polypropylene, polyvinyl acetate or comparable compounds, added to the web in such a proportion that the low melt thermoplastic powder comprises between 5% and 40% of the total fiber content, with an optimum percentage of 18%. The powder particles are generally not uniform in size, although the majority is in the range of 40 to 200 U.S. Standard Mesh. Commercially available low-melt thermoplastic powders that may be suitable for use in this embodiment of the invention include "EASTOBOND" (FA 252 or FA 300), a polyester by Eastman Chemical Co. and "VINOL", a polyvinyl alcohol by Air Products, Inc.

The fibers may also be treated with a fiber lubricant or finish before or during processing to permit subsequent needling operations to be performed. This step is no shown in FIGS. 2 and 3. Such a fiber finish precludes excessive needle breakage, poor fiber penetration, inefficient stitching and reduced stitching rates. In the preferred embodiment, the finish is composed of butoxyethyl stearate that is applied in amount of 0.5% to 3.0% by weight to the fibers before webbing or to the web before cross-lapping and other web consolidation process or to the batt before needling and stitching. Other finishes may include silicone lubricants, metallic soaps and low molecular weight polyethylene waxes to provide needle lubrication. Methods of application include padding, spraying or immersion and press rolling.

The fibers may further be treated with a flame retarding compound, as shown in phantom in FIGS. 2 and 3. In the preferred embodiment, the flame retardant compounds, in liquid or powder form, and the add-on to the fiber on a weight percentage, are as follows:

| | Add-on (weight percentage) | |
|---|---|---|
| | Range | Preferred |
| Liquid Percentage | | |
| Ammonium Sulfamate | 20 to 40% | 25% |
| Phosphonium Chloride | 5 to 30% | 15% |
| Phosphonium Sulfate | 5 to 30% | 15% |
| Powder | | |
| Chlorinated Parraffin | 5 to 10% | 6% |
| Boric Acid | 10 to 20% | 12% |

Add-on is calculated as:

$$\frac{\text{Pounds Of Flame Retarding Material}}{\text{Pounds Of Fiber}} \times 100$$

Flame retardant compounds in the liquid form are added to the fiber before the individualizing step in a conventionally known padding bath in order to reach the required add-on, as shown in phantom in FIGS. 2 and 3. The fiber is then pressed through rolls and dried in a hot air oven. The preferred embodiments use powdered flame retardant compounds, which do not require the additional steps of treating the fiber in a padding bath, pressing the fiber and drying it.

The flame retardant compounds in powdered form can be added before or during the blending step in the process using low melt thermoplastic fiber, as shown in phantom in FIG. 2. For the process using low melt thermoplastic powder, the preferred embodiment includes providing the powder flame retardant compound during the step in which the low melt thermoplastic powder is provided in the single layer batt, as shown in FIG. 3.

The fibrous web is increased in thickness by cross-lapping or layering through the use of conventionally known multiple forming devices, such as disclosed in U.S. Pat. No. 4,183,985, issued to Lemieux on Jan. 15, 1980. The resulting batt is stabilized for further processing by needling at a specified density of 250 penetrations per square inch, to achieve a weight of preferably between 4 and 14 ounces per square yard before stitching. The batt is stitched in the machine direction using yarn or thread in various stitch configurations, resulting in the fixing of individual fiber groups relative to the fibrous batt an preventing their movement in the cross or machine direction of the web.

Stitching yarns can be cotton or polyester and are preferably between 15 and 52 singles. Stitching filaments may also be used, and are preferably of polyester, nylon or olefin between 75 and 250 denier. Stitching patterns are preferably chain or tricot at a linear cross web spacing density of 5 to 15 per inch and 5 to 30 stitches per inch.

The resulting batt is thermal bonded after it has been stitch bonded through the use of a gas or electric oven, or an infrared tunnel. This step is required to heat the thermoplastic fiber to its melting point, when it flows around the adjacent cellulosic fibers, yarns and/or threads, providing a strong bond after the thermoplastic material solidifies. The fusion temperature is preferably between 200° F. and 390° F. The resulting fabric is then subject to conventional techniques of fabric roll-up.

The non-woven fabric can be made into a spiral bag by spiral sewing a continuous length of fabric in a manner similar to the construction of a paper soda straw. For example, a 70" wide continuous length of fabric can be spiral sewn at a 45° angle for best stretch. Other widths of non-woven fabric sewn at other angles are also comprehended. The seam used can be either the folded, conventional, side-by-side or overlap seam. Universal Density and Standard Density bales of cotton are wired or strapped bare (without any cover), then stuffed into the spiral bag for coverage.

In another method of practice, a shoebox-type bag for flat bales, for example, is placed on the bottom of the baler. A sheet is placed on the top of the baler. After the cotton is pressed, the bag is pulled up to cover ¾ of the bale. The sheet is stuffed into and around the bag to completely cover the cotton. The bale is then wired over the bag and the sheet cover.

The non-woven fabric of the invention uses a combination of stitch bonding and thermal bonding to provide high strength in all fabric directions. The resulting web has significantly better strength and structural integrity than webs bonded by spray bonding or stitch bonding alone. The improved resistance to tearing and stretching is provided by the non-woven fabric of the invention because fibers are bonded individually by the thermal fibers or powders as well as in bundles by the stitching yarns, threads or filaments.

FIG. 2 illustrates in flow-chart form, the process for producing the non-woven fabric, wherein low-melt thermoplastic fiber is blended with the cellulosic fiber as a preliminary step. The final step in the production of the non-woven fabric is thermal bonding, previously described. The commercial preparation steps of fabric roll-up and bag sewing are shown in phantom.

FIG. 3 illustrates in flow-chart form, a process for producing the non-woven fabric, wherein low-melt thermoplastic powder, previously described, is added to the web between the cross-lapping and needle tacking steps. Thermal bonding is accomplished by the same method as the process illustrated in FIG. 2. The commercial preparation steps of fabric roll-up and bag sewing are shown in phantom.

EXAMPLE 1

Raw cotton fiber or fire retardant treated fiber in bale form is placed in a skimmer type bale opener or an equivalent device. Fiber is removed from the bale surface, and mechanically transported to a weigh pan feeder or other mass proportioning device. In one embodiment, low melting point thermoplastic fiber is similarly removed from a bale and mechanically transported to the weigh pan feeder.

The fibers are then weighed so that the ratio of low melt thermoplastic fiber comprises between 5% and 40% of the total fiber content, the optimum being 18%. The cotton or fire retardant-treated fiber and the low melt thermoplastic fiber are dumped into a combining chamber that leads into a fiber blending unit. This unit is a series of high speed cylindrical rolls covered with metallic wire card clothing that effectively blends the two fibers.

These blended fibers are then subjected to further opening or separation. The opened and blended fibers are conveyed by mechanical means or an air stream to a chute feeder or other appropriate fiber leveling device and feeding system. The mass of fiber is guided into a feed roll arrangement that creates a uniform and level mat of fibers for introduction into the web forming equipment. This may be alternatively a card, a garnet, air-lay machine or other web forming device that further opens the fiber and arranges them in a web where the fibers lie predominantly parallel, or in a random fibrous structure.

Where the fibrous web is formed by a card or a garnet, the resulting fibrous web is cross-lapped into a web having the proper weight per unit area of 7 oz/yd$^2$ and width. This step places the parallel fibers in an angular arrangement as viewed from layer to layer, and results in a relatively random fiber arrangement in the finished product. This aspect is important in providing the proper balance of machine and cross directional strength in the fabric of the invention. For webs formed by the air-lay process, the fibrous structure is generally random, and may be cross-lapped for strength.

In the embodiment employing low melt thermoplastic powder, the resulting web, at the correct weight and width, is transferred by a moving apron or belt to the bonding powder applicator. Bonding powder is applied using conventional commercial powder application equipment that applies powder to the web at a predetermined rate to produce the correct add-on of powder.

The web is then transported to the needle tacker. This machine contains a horizontally mounted plate containing vertically mounted barbed needles at a density of 5 to 50 needles per square inch. The plate reciprocates vertically as the web passes below. The rate of reciprocation and web speed are synchronized to provide the required number of penetrations to lightly compact the web prior to stitch bonding. For the embodiment using low melt thermoplastic powder, this step also helps to distribute the powder uniformly throughout the web.

The compacted web is then fed into the stitch bonding machine. This apparatus is a series of stitching needles arranged on a reciprocating bar perpendicular to the web direction. The number of needles per linear inch ranges from 3.5 to 15.

The stitching needles pierce through the web while guide needles on the opposite side place stitching yarns into the hooks of the stitching needles. Stitch formation is accomplished by temporarily covering the hooks with closing wires creating a tricot or chain stitch, depending on fabric requirements.

The stitch bonded web is then transported to the thermal bonding oven which can be directly heated by radiant electrical heaters or indirectly by gas firing. The temperature must be raised beyond the melting point of the thermoplastic powder or fiber so that it will have adequate fluidity to flow around the fibers, thereby creating a strong bond through encapsulation of the fibers of the fibrous web and of the stitching yarns.

The finished web is then slit to the correct width and rolled into conveniently sized rolls for subsequent production of the bale bag using conventional spiral sewing techniques.

EXAMPLE 2

Testing was performed on the non-woven fabric of the invention, employing cotton fiber, and on the conventionally known woven cotton and woven polypropylene cotton bale wraps. Fibrillation is generally tested by cutting the material and determining its tendency to divide into fine, smaller fibers or strands that contaminate raw cotton. Superior results are shown for the non-woven fabric of the invention over the conventional woven polypropylene wrap:

| Material | Non-Woven Fabric (cotton) | Woven Cotton | Woven Polypropylene |
|---|---|---|---|
| Fibrillation Tendency | No | No | Yes |
| Biodegradability | Yes | Yes | No |

It will be apparent to those skilled in the art, that the present invention may be practiced in a wider variety of embodiments without materially departing from the spirit and scope of this invention. It is also to be understood that in the foregoing specification, specific embodiments and components thereof, have been illustrated and discussed by way of illustration only and not of limitation, and that the invention may be practiced by those skilled in the art utilizing a wide variety of materials and configurations without departing from the true spirit of the invention.

What is claimed is:

1. A cotton bale cover comprising a single layer of non-woven fiber being produced by the steps of:
   (a) blending natural cellulosic fiber with low melt thermoplastic fiber to form a blend, wherein said blend comprises 5% to 40% low melt thermoplastic fiber;
   (b) separating said fiber blend into individual fibers;
   (c) forming a fibrous web of said individual fibers;
   (d) cross-lapping said fibrous web to form a single layer batt;
   (e) needle tacking said batt;
   (f) stitch bonding said batt; and subsequently
   (g) heating said batt to cause said low melt thermoplastic fiber to flow continuously with said natural cellulosic fiber in said batt.

2. A cotton bale cover comprising a single layer of non-woven fiber being produced by the steps of:
   (a) separating natural cellulosic fiber into individual fibers;
   (b) forming a fibrous web of said individual fibers;
   (c) cross-lapping said fibrous web to form a single layer batt;
   (d) adding low melt thermoplastic powder to said batt;
   (e) needle tacking said batt;
   (f) stitch bonding said batt; and subsequently
   (g) heating said batt to cause said low melt thermoplastic fiber to flow continuously with said natural cellulosic fiber in said batt.

3. A cotton bale covering according to claim 1, wherein said fabric is in the form of a spiral tube.

4. A cotton bale covering according to claim 2, wherein said fabric is in the form of a spiral tube.

5. A cotton bale cover comprising a single layer of non-woven fiber comprising:
   a single batt layer formed of cross-lapped natural cellulosic fiber, said batt having a compacted structure by needle tacking extending throughout said batt;
   thermally set low melt thermoplastic material intermixed throughout said fiber in a ratio of 5% to 40% of said fiber, said thermally set low melt thermoplastic material bonding said natural cellulosic fiber in said batt; and
   stitch bonding extending throughout said batt.

6. A process for producing a non-woven fabric suitable for use as a cotton bale covering comprising the steps of:
   (a) blending natural cellulosic fiber with low melt thermoplastic fiber to form a blend, wherein said blend comprises 5% to 40% low melt thermoplastic fiber;
   (b) separating said fiber blend into individual fibers;
   (c) forming a fibrous web of said individual fibers;
   (d) cross-lapping said fibrous web to form a single layer batt;
   (e) needle tacking said batt;
   (f) stitch bonding said batt; and subsequently
   (g) heating said batt to cause said low melt thermoplastic fiber to flow continuously with said natural cellulosic fiber in said batt.

7. A process for producing a non-woven fabric suitable for use as a cotton bale covering comprising the steps of:
   (a) separating natural cellulosic fiber into individual fibers;
   (b) forming a fibrous web of said individual fibers;
   (c) cross-lapping said fibrous web to form a single layer batt;
   (d) adding low melt thermoplastic powder to said batt;
   (e) needle tacking said batt;
   (f) stitch bonding said batt; and subsequently
   (g) heating said batt to cause said low melt thermoplastic fiber to flow continuously with said natural cellulosic fiber in said batt.

8. A process according to claim 6, further including the step of applying a fiber lubricant means to said natural cellulosic fiber and said low melt thermoplastic fiber before said step (e).

9. A process according to claim 8, wherein said lubricant means comprises butoxyethyl stearate applied in the range of 0.5% to 3.0% by weight to said individual fibers before said step (b).

10. A process according to claim 8, wherein said lubricant means comprises butoxyethyl stearate applied in the range of 0.5% to 3.0% by weight to said fibrous web before said step (d).

11. A process according to claim 8, wherein said lubricant is selected from the group consisting of silicone, metallic soaps and low molecular weight polyethylene waxes.

12. A process according to claim 6, wherein said step (f) includes stitching said batt with a threading means for locking said individual fibers to increase the tear and burst strength of said fabric.

13. A process according to claim 6, wherein said step (f) includes stitching said batt with cotton or polyester yarn in the range of 15 to 52 singles.

14. A process according to claim 6, wherein said step (f) includes stitching said batt with thread.

15. A process according to claim 6, wherein said step (f) includes stitching said batt with filament in the range of between 75 and 250 denier.

16. A process according to claim 15, wherein said filament is selected from a group consisting of polyester, nylon and olefin.

17. A process according to claim 6, wherein said step (a) includes using natural cellulosic fibers and low melt thermoplastic fibers having a length in the range of 0.25 inch to 2½ inches, and a denier in the range of 0.8 to 20.0.

18. A process according to claim 6, wherein said step (a) includes providing low melt thermoplastic fiber selected from the group consisting of polyethylene, polyester, polypropylene, and polyvinyl acetate, said low melt thermoplastic fiber having a length in the range of 0.25 inch to 2 inches and a denier in the range of 1.0 to 10.0.

19. A process according to claim 6, wherein said step (g) is performed at a temperature in the range of 200° F. to 390° F.

20. A process according to claim 6, further including the step of treating said natural cellulosic fiber and said low melt thermoplastic fiber with a liquid flame retarding compound selected from the group consisting of ammonium sulfamate, phosphonium chloride and phosphonium sulfate.

21. A process according to claim 20, wherein said treating step includes treating said natural cellulosic fiber and said low melt thermoplastic fiber with liquid ammonium sulfamate in the add-on range of 20% to 40%.

22. A process according to claim 20, wherein said treating step includes treating said natural cellulosic fiber and said low melt thermoplastic fiber with liquid phosphonium chloride in the add-on range of 5% to 30%.

23. A process according to claim 20, wherein said treating step includes treating said natural cellulosic fiber and said low melt thermoplastic fiber with liquid phosphonium sulfate in the add-on range of 5% to 30%.

24. A process according to claim 6, wherein said treating step includes treating said natural cellulosic fiber and said low melt thermoplastic fiber with a powder flame retarding compound selected from the group consisting of chlorinated paraffin and boric acid.

25. A process according to claim 24, wherein said treating step includes treating said natural cellulosic fiber and said low melt thermoplastic fiber with powdered chlorinated paraffin in the add-on range of 5% to 10%.

26. A process according to claim 24, wherein said treating step includes treating said natural cellulosic fiber and said low melt thermoplastic fiber with powdered boric acid in the add-on range of 10% to 20%.

27. A process according to claim 7, further including the step of applying a fiber lubricant means to said natural cellulosic fiber before said step (e).

28. A process according to claim 27, wherein said lubricant means comprises butoxyethyl stearate applied in the range of 0.5% to 3.0% by weight to said natural cellulosic fiber before said step (b).

29. A process according to claim 27, wherein said lubricant means comprises butoxyethyl stearate applied in the range of 0.5% to 3.0% by weight to said fibrous web before said step (c).

30. A process according to claim 27, wherein said lubricant is selected from the group consisting of silicone, metallic soaps and low molecular weight polyethylene waxes.

31. A process according to claim 7, wherein said step (f) includes stitching said batt with a threading means for locking said individual fibers to increase the tear and burst strength of said fabric.

32. A process according to claim 7, wherein said step (f) includes stitching said batt with cotton or polyester yarn in the range of 15 to 52 singles.

33. A process according to claim 7, wherein said step (f) includes stitching said batt with thread.

34. A process according to claim 7, wherein said step (f) includes stitching said batt with filament in the range of between 75 and 250 denier.

35. A process according to claim 34, wherein said filament is selected from the group consisting of polyester nylon and olefin.

36. A process according to claim 7, wherein said step (a) includes using natural cellulosic fibers having a length in the range of 0.25 inch to 2½ inches, and a denier in the range of 0.8 to 20.0.

37. A process according to claim 7, wherein said step (g) is performed at a temperature in the range of 200° F. to 390° F.

38. A process according to claim 7, further including the step of treating said natural cellulosic fiber with a liquid flame retarding compound selected from the group consisting of ammonium sulfamate, phosphonium chloride and phosphonium sulfate.

39. A process according to claim 38, wherein said treating step includes treating said natural cellulosic fiber with liquid ammonium sulfamate in the add-on range of 20% to 40%.

40. A process according to claim 38, wherein said treating step includes treating said natural cellulosic fiber with liquid phosphonium chloride in the add-on range of 5% to 30%.

41. A process according to claim 38, wherein said treating step includes treating said natural cellulosic fiber with liquid phosphonium sulfate in the add-on range of 5% to 30%.

42. A process according to claim 7, wherein said treating step includes treating said natural cellulosic fiber with a powder flame retarding compound selected from the group consisting of chlorinated paraffin and boric acid.

43. A process according to claim 42, wherein said treating step includes treating said natural cellulosic fiber with powdered chlorinated paraffin in the add-on range of 5% to 10%.

44. A process according to claim 42, wherein said treating step includes treating said natural cellulosic fiber with powdered boric acid in the add-on range of 10% to 20%.

45. A process according to claim 7, wherein said step (d) includes adding low melt thermoplastic powder selected from the group consisting of polyethylene, polyester, polypropylene, and polyvinyl acetate, said powder having a size that is substantially in the range of 40 to 5200 U.S. Standard Mesh.

* * * * *